US008028981B2

(12) United States Patent
Graushar

(10) Patent No.: US 8,028,981 B2
(45) Date of Patent: Oct. 4, 2011

(54) METHOD OF DELIVERING A PRINTED PRODUCT TO A BINDING OR MAILING LINE

(75) Inventor: William T. Graushar, Elm Grove, WI (US)

(73) Assignee: Quad/Graphics, Inc., Sussex, WI (US)

( * ) Notice: Subject to any disclaimer, the term of this patent is extended or adjusted under 35 U.S.C. 154(b) by 60 days.

(21) Appl. No.: 12/621,538

(22) Filed: Nov. 19, 2009

(65) Prior Publication Data

US 2010/0059917 A1 Mar. 11, 2010

Related U.S. Application Data

(63) Continuation of application No. 11/959,685, filed on Dec. 19, 2007, now abandoned, which is a continuation of application No. 10/378,135, filed on Mar. 4, 2003, now abandoned.

(51) Int. Cl.
*B65H 5/00* (2006.01)

(52) U.S. Cl. ..... 270/52.03; 270/1.01; 270/52.16; 270/58.29

(58) Field of Classification Search ..... 270/1.01, 270/52.02, 52.03, 52.16, 52.19, 52.29, 58.29
See application file for complete search history.

(56) References Cited

U.S. PATENT DOCUMENTS 3,608,888 A 9/1971 McCain et al.
3,796,487 A 3/1974 Voorhees
3,804,005 A 4/1974 Burger et al.
3,819,173 A 6/1974 Anderson et al.
3,899,165 A 8/1975 Abram et al.
3,917,252 A 11/1975 Harder et al.
3,966,186 A 6/1976 Helm
4,022,455 A 5/1977 Newsome et al.
4,065,117 A 12/1977 Thorsheim
4,121,818 A 10/1978 Riley et al.
4,149,711 A 4/1979 Jackson
4,273,319 A 6/1981 Stocker
4,388,994 A 6/1983 Suda et al.
4,502,676 A 3/1985 Stocker
4,576,370 A 3/1986 Jackson
4,580,770 A 4/1986 Warden et al.
4,582,312 A 4/1986 Abrams et al.
RE32,690 E 6/1988 Wong
4,799,661 A 1/1989 Nail
4,800,504 A 1/1989 Durst, Jr. et al.
4,800,505 A 1/1989 Axlerod et al.
4,800,506 A 1/1989 Axlerod et al.
4,835,544 A 5/1989 Winterburn
4,953,841 A 9/1990 Polarek
4,989,852 A 2/1991 Gunther, Jr.
(Continued)

*Primary Examiner* — Leslie A Nicholson, III
(74) *Attorney, Agent, or Firm* — Michael Best & Friedrich LLP

(57) ABSTRACT

A method of delivering signatures to a finishing line includes generating an assembly order. The assembly order is provided to a controller that is operatively associated with a feeder that comprises a print-on-demand printer. Paper is provided to the print-on-demand printer. The controller controls printing on a signature with the print-on-demand printer according to the assembly order. The controller controls feeding the signature to a first pocket on the finishing line and delivering the signature from the first pocket to the finishing line according to the assembly order. The controller controls printing on an additional signature with the print-on-demand printer according to the assembly order. The controller controls feeding the additional signature to the first pocket, and delivering the additional signature from the first pocket to the finishing line according to the assembly order.

3 Claims, 7 Drawing Sheets

U.S. PATENT DOCUMENTS 5,013,022 A 5/1991 Graushar
5,033,725 A 7/1991 van Duursen
5,039,077 A 8/1991 Gunther, Jr.
5,067,088 A 11/1991 Schneiderhan
5,114,128 A 5/1992 Harris et al.
5,143,362 A 9/1992 Doane et al.
5,186,443 A 2/1993 Manley et al.
5,287,976 A 2/1994 Mayer et al.
5,419,541 A 5/1995 Stevens
5,458,323 A 10/1995 Magee et al.
5,510,997 A 4/1996 Hines et al.
5,547,175 A 8/1996 Graushar et al.
5,547,178 A 8/1996 Costello
5,655,759 A 8/1997 Perkins et al.
5,707,055 A 1/1998 DeJoseph et al.
5,745,590 A 4/1998 Pollard
5,838,574 A 11/1998 Olson et al.
5,918,879 A 7/1999 Steinhilber
5,988,620 A 11/1999 Graushar
6,012,890 A * 1/2000 Celorio Garrido ..... 412/19
6,167,326 A 12/2000 Graushar et al.
6,192,295 B1 2/2001 Gunther
6,240,334 B1 5/2001 Duke et al.
6,257,566 B1 * 7/2001 Dooley ..... 270/52.18
6,519,503 B2 2/2003 Paterson et al.
6,670,569 B2 12/2003 Smith et al.
6,767,011 B2 7/2004 Kavanah
6,974,034 B2 12/2005 Smith et al.
7,096,088 B2 8/2006 Graushar et al.
7,198,260 B2 4/2007 Huber et al.
2003/0112479 A1 6/2003 Huber et al.
2003/0195788 A1 10/2003 Loeb et al.

* cited by examiner

METHOD OF DELIVERING A PRINTED PRODUCT TO A BINDING OR MAILING LINE

CROSS-REFERENCE TO RELATED APPLICATIONS

This application is a continuation of U.S. patent application Ser. No. 11/959,685, filed Dec. 19, 2007, which is a continuation of U.S. patent application Ser. No. 10/378,135, filed Mar. 4, 2003, the entire contents of both applications are hereby incorporated by reference herein.

BACKGROUND

The present invention relates to a method of delivering a printed product to a binding or mailing line, and more particularly to a method of sequentially delivering printed products to a binding or mailing line.

Book as used herein refers to books, catalogs, magazines, pamphlets, envelopes and other printed materials. Books are typically assembled through either conventional saddle stitch or perfect binding processes and it should be noted that the present invention may be used in conjunction with saddle stitch, perfect binding, and other binding methods.

Publishers of printed media are continually looking to gain market share by maintaining and increasing the number of subscribers to its printed media. To help the publishers achieve their goals, printers provide publishers the capability of customizing printed media based on general demographic regions, the particular recipient, and the recipient's interests.

Books are generally comprised of one or more signatures. Signature as used herein generically refers to paper pages and/or packaging inserts. A signature may be printed by a printing press, a laser printer, an ink jet printer, a non-contact printer or any other type of printer. Printed products include both books and signature.

A book may be customized by including particular signatures within the book based on the location where the book will be sold. Books may be customized by including particular signatures within the book based on characteristics and interests of the recipient. Books may also be customized with the addition of inserts, inserts, electronic media, and the like.

A book may be further customized by including unique personalized information or indicia related to the recipient. A common way to personalize the book is to print the recipient's name and address information on the cover of the book once the book is assembled. The book may be further personalized by printing personalized indicia onto one or more signatures before or after the signatures are assembled into a book.

Signatures are often personalized while they are on the binding line by using an ink jet printer positioned near the binding line. As the signatures pass the ink jet printer, personalized information or indicia is printed onto one or more of the signatures or covers. Signatures may also be pre-personalized in a separate off-line printing process prior to being fed onto the binding line.

SUMMARY

In one construction, the invention provides a method of delivering signatures to a finishing line. An assembly order is generated. The assembly order is provided to a controller that is operatively associated with a feeder that comprises a print-on-demand printer. The controller controls each of the following steps according to the assembly order: feeding blank paper to the print-on-demand printer of the feeder, printing a signature of the assembly order with the print-on-demand printer of the feeder, feeding the signature to a first pocket on the finishing line, feeding the signature from the first pocket to the finishing line, printing an additional signature of the assembly order with the print-on-demand printer, feeding the additional signature to the first pocket, and feeding the additional signature from the first pocket to the finishing line.

In another construction, the invention provides a signature delivery apparatus including a roll of blank paper, a feeder, a pocket, and a controller. The feeder includes a print-on-demand printer configured to receive blank paper from the roll. The pocket is associated with the feeder and configured to receive finished signatures that are printed by the print-on-demand printer and fed from the feeder. The controller is operatively associated with the feeder, the print-on-demand printer, and the pocket and configured to receive an assembly order. The controller is configured to control operation of the print-on-demand printer to print a signature and an additional signature of the assembly order from the blank paper, to control operation of the feeder to feed the signature and the additional signature to the pocket according to the assembly order, and to control operation of the pocket to feed the signature and the additional signature to the finishing line.

In yet another construction, the invention provides a signature delivery apparatus for a finishing line. The apparatus includes means for storing blank paper and means for generating finished signatures from the blank paper. The means for generating includes a means for printing on the blank paper to generate finished signatures. The apparatus further includes means for delivering the finished signatures that are printed by the means for printing to the finishing line, and means for controlling the means for generating, the means for printing, and the means for delivering. The means for controlling is configured to receive an assembly order and to control operation of the means for printing to print a signature and an additional signature from the blank paper, and to control operation of the means for generating to feed the signature and the additional signature to the means for delivering according to the assembly order, and to control operation of the means for delivering to feed the signature and the additional signature to the finishing line.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

Figure 1:
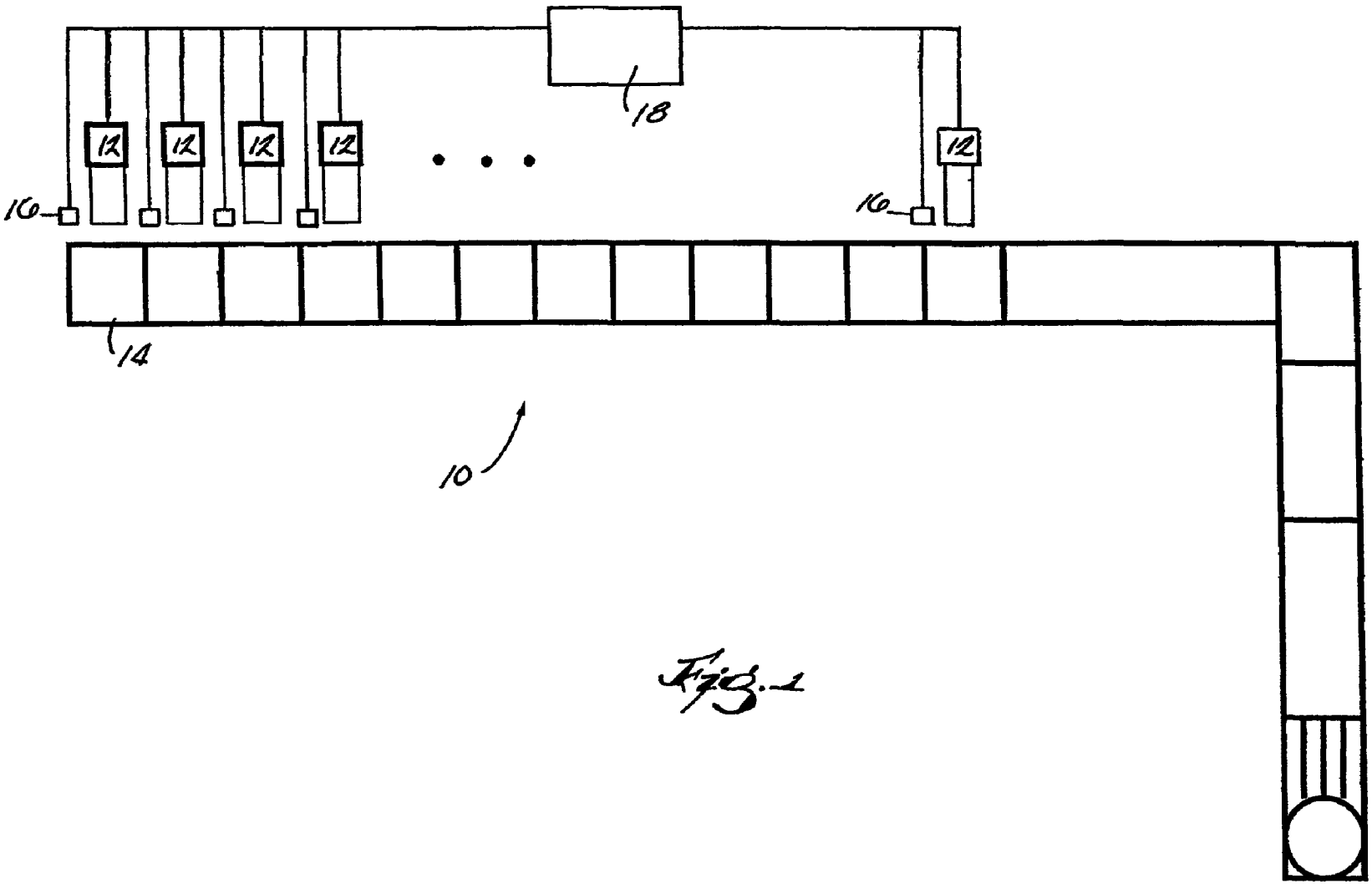
FIG. 1 is a plan view of a binding line for assembling a book.

FIG. 1 illustrates a binding line 10 for assembling books. The binding line 10 includes a plurality of feeders 12 and a conveyor line 14. The feeders 12 contain signatures that will comprise a book. Although only five feeders 12 are shown delivering signatures to the conveyor line 14, it should be understood that binding line 10 may include additional or less feeders 12. In addition, any conventional feeder 12 can be used as part of the binding line 10 without departing from the scope of the present invention.

The binding line 10 includes a reader 16, i.e., bar code reader, scanner, etc., adjacent to each feeder 12. The readers 16 connect to a controller 18, as is known in the art, that processes the output from the readers 16. A suitable controller 18 is the FCS 2000 available from Quad/Tech, Inc. in Sussex, Wis. The controller 18 connects to the feeders 12 to control the delivery of the appropriate signature to the conveyor line 14.

The binding line 10 may include additional feeders, a print station, an inspection station, a stitcher, a trimming station, and a stacker downstream of the feeders 12 as are known in the art. The additional feeders positioned downstream of the feeders 12 may feed additional signatures and/or selective items, such as, order forms, postcards, special-interest publications, CD-ROMs, DVDs, subscription cards, promotional offers, coupons, etc. The print station can include an ink jet printer that prints personalized indicia, i.e., recipient name and address, on the cover or on an interior page of a book. The inspection station inspects each book for appropriate thickness or print quality by a caliper or other sensor. This information is transmitted to the controller 18, which compares the measured thickness or print quality with a reference thickness or print quality in order to determine if the book has been appropriately assembled. If an error was made in the assembly of the book, the book is rejected from the binding line 10.

The stitcher binds, i.e., stapled, glued, stitched, and fastened, each book, and the trimming station trims the edges of each book. The stacker bundles together books that are being delivered to a common zip code, or other predetermined order, for easy handling by the U.S. Postal Service. Other stations or operations may be included in the binding line 10 that are known in the art.

Figure 2:
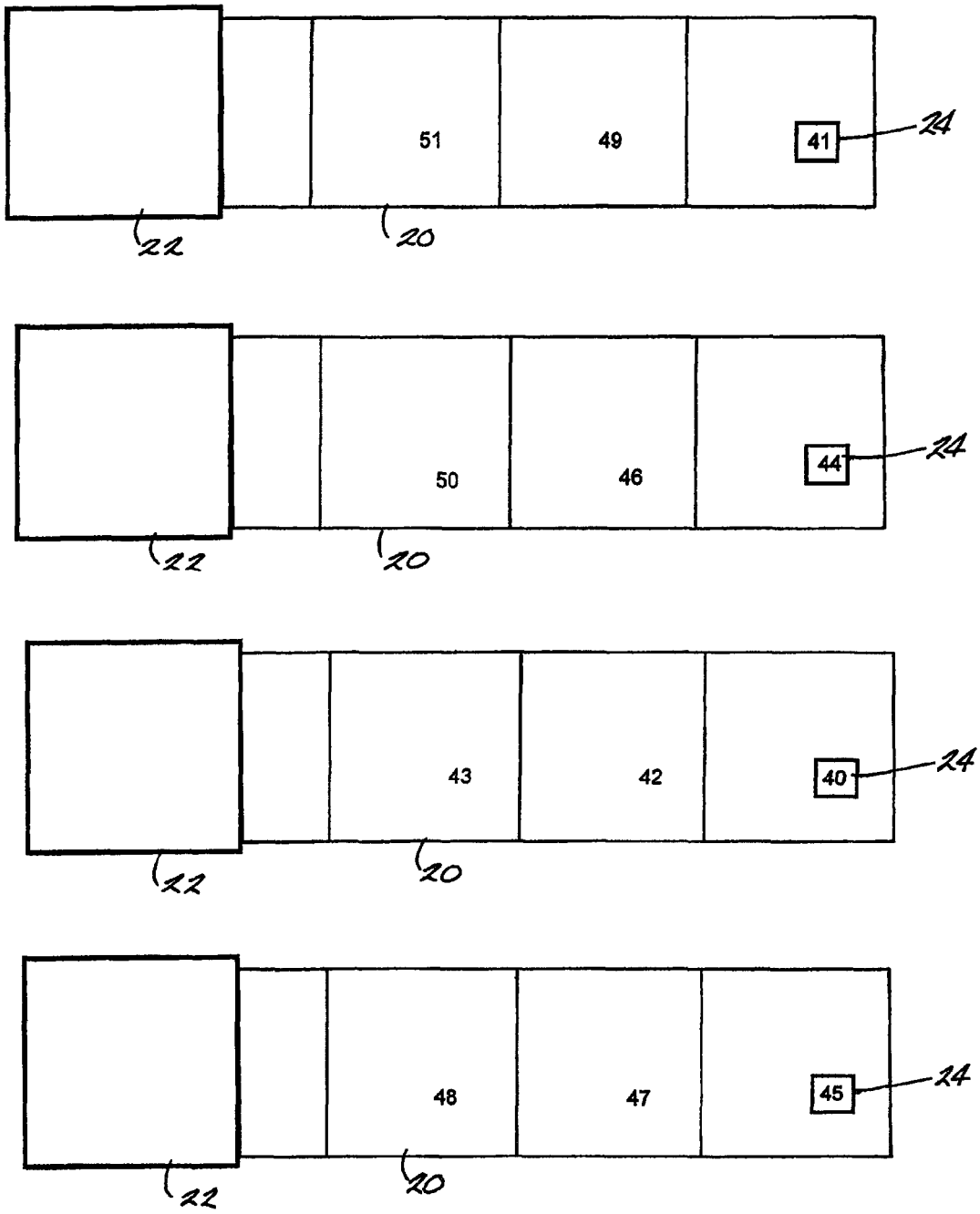
FIG. 2 is an exemplary illustration of a roll of signatures including sequence codes.

FIG. 2 illustrates stored signatures such as on the four rolls 22. The pre-printed signatures 20 may also be wound onto a roll 22 in a fan fold method. Further, other storage methods may also be utilized in addition to rolls such as containers, piles, and the like, that keep a sequence. Each signature 20 on a roll may have the same content or different content depending on the publication. The content may include advertising, special promotional offers, or subscriber indicia, and the content may vary depending on the subscriber's demographics and interests. Each signature 20 includes thereon a sequence code 24. The sequence code 24 may be a U.S. Postal Service zip code, a bar code, a reference number, a sequence number or any identifying code. The sequence code 24 may be printed with invisible ink.

Figure 3:
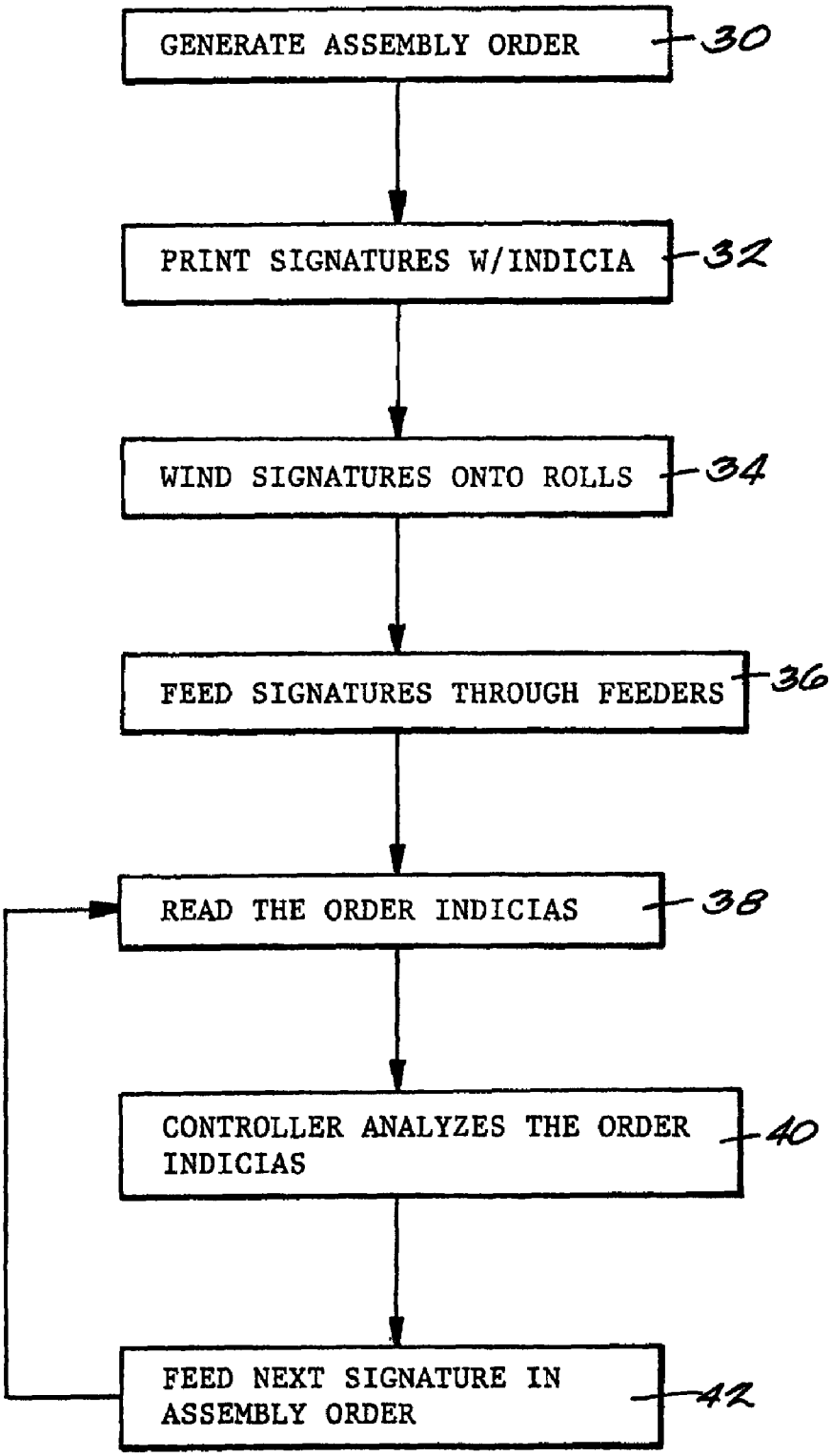
FIG. 3 is a flow chart illustrating a method of delivering a signature to the binding line.

One embodiment of the method of the invention is illustrated in the flow chart in FIG. 3. Prior to printing the signatures 20, an assembly order is generated at step 30. The assembly order may be an order to build the books being delivered to a common zip code, or other predetermined order, for easy handling by the U.S. Postal Service or any other delivery service. Based on the assembly order, signatures are printed that each include the sequence code 24 at step 32. At step 34, the printed signatures 20 are wound onto one of several rolls 22 according to the assembly order.

Each wound roll 22 is positioned adjacent to a feeder 12 and each signature 20 is separated from the role and fed through the corresponding feeder 12 toward the reader 16 at step 36. At step 38, the reader 16 reads the sequence code 24 on each signature that is nearest the conveyor line 14, that is, next-in-line. At step 40, the controller 18 analyzes the outputs from each of the readers 16 to determine which signature of those that are next-in-line for each roll 22 is next in the assembly order. The controller 18 sends a signal to a respective feeder 12 to feed the next signature in the assembly order at step 42. Once a signature is fed to the conveyor line 14, the next signature on the roll takes its place as being next-in-line. The process continues at step 38. The reader 16 reads the sequence code 24 on each signature that is next-in-line for each roll 22. The controller 18 analyzes the reader 16 output and transmits a signal to the feeder 12 to feed the next signature in the assembly order. It should also be noted that a signature could be separated from its respective roll 22 after the sequence code 24 thereon has been read by the reader 16.

Figure 4:
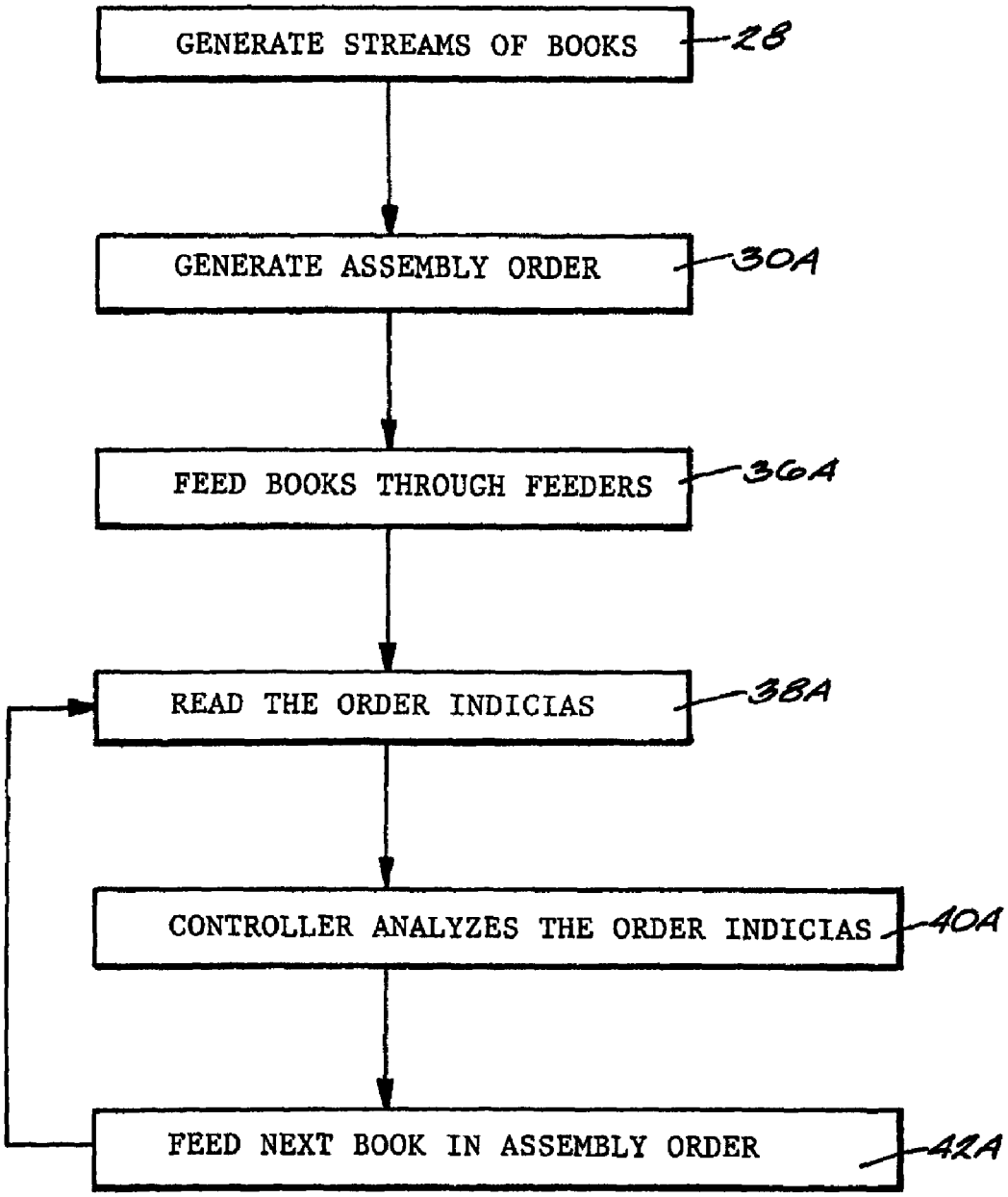
FIG. 4 is a flow chart illustrating a method of delivering a book to a mailing line.

Another embodiment of the invention is illustrated in the flow chart in FIG. 4. Common steps are identified by the same reference number with an appended "A". Several streams of books including order indicia 24 are generated in an off-line process at step 28. The streams of books may be the same publication or various types of publications, mail, or other printed pieces. Each stream of books may also be of a differing class of mail, e.g., first class, second class, or third class, from another stream of books. Each stream of books may also include mixed classes of printed pieces. The combination of streams of books reduces costs to mailers and reduces the handling costs to the U.S. Postal Service.

Next, an assembly order is generated at step 30A by analyzing the various files that generated each stream of books. Each stream of books is fed to a feeder 12. Each book is fed through the corresponding feeder 12 toward the reader 16 at step 36A. The reader 16 reads, at step 38A, the sequence code 24 on each book that is nearest the conveyor line 14. At step 40A, the controller 18 analyzes the outputs from each of the readers 16 to determine which book is next in the assembly order. The controller 18 sends a signal to the feeder 12 to feed the next book in the assembly order at step 42A to the mailing line. The process continues at step 38A. The reader 16 reads the order indicia 24 on each book that is nearest the conveyor 14. The controller 18 analyzes the reader 16 output and transmits a signal to the feeder 12 to feed the next book in the assembly order.

Figure 5:
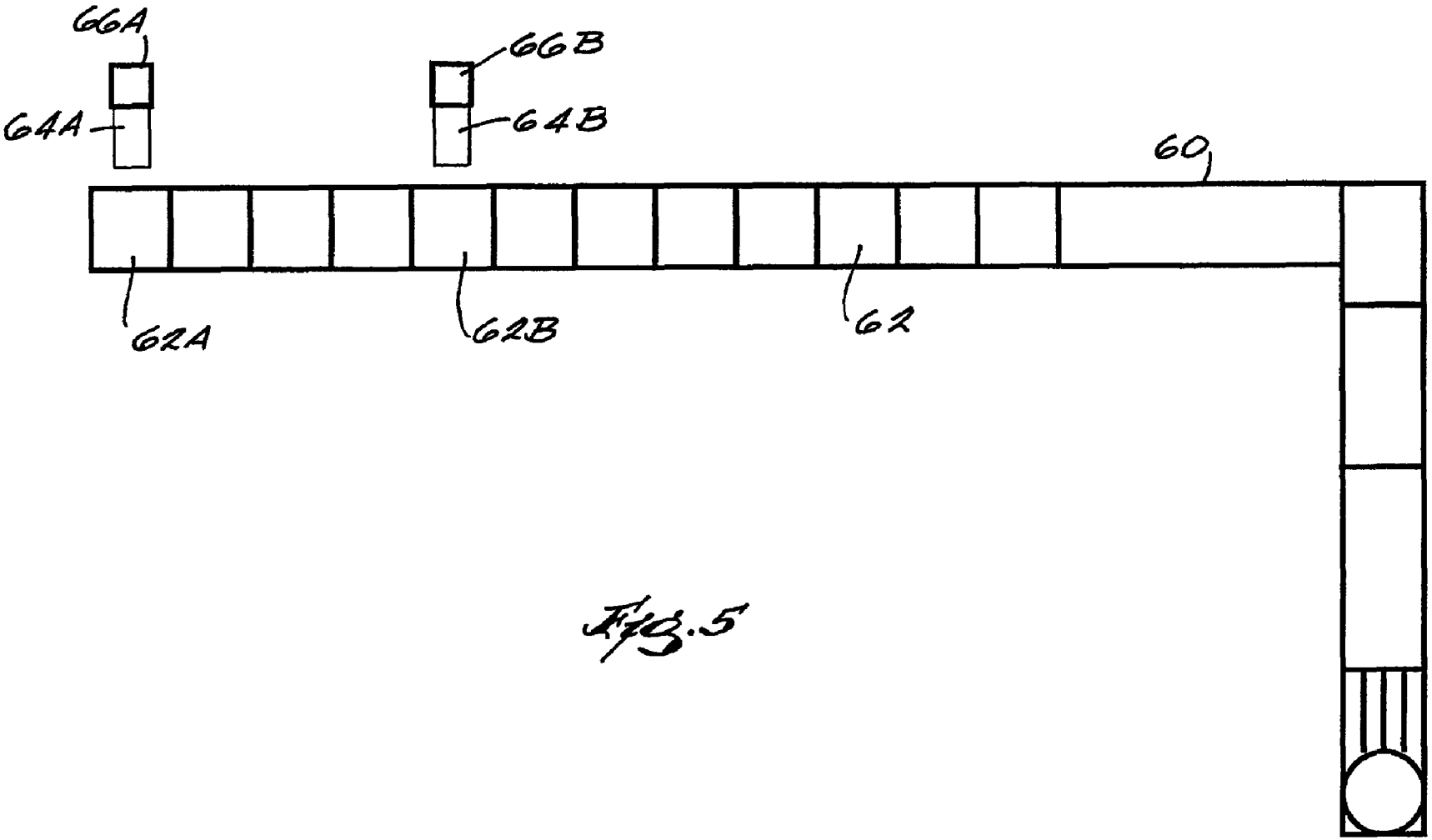
FIG. 5 is a plan view of a binding line for assembling a book.
Figure 6:
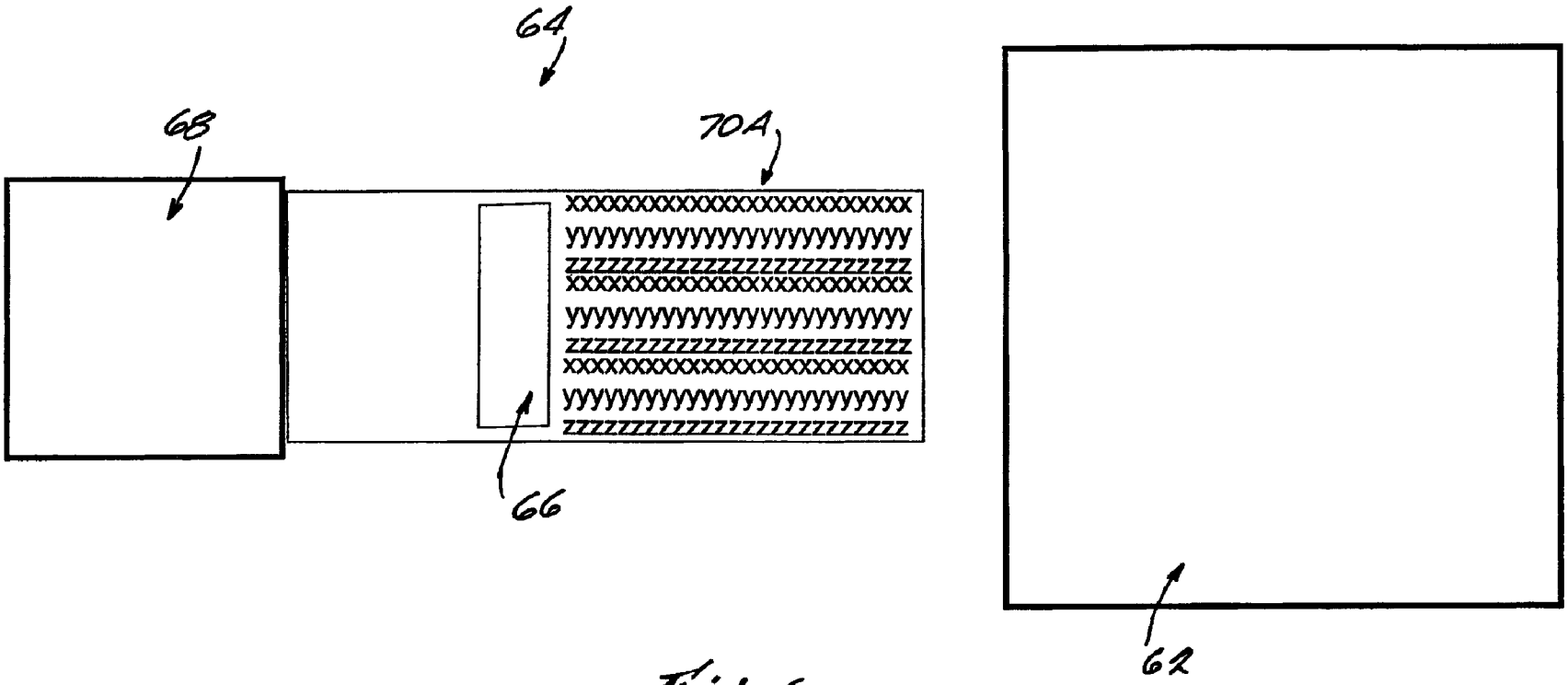
FIG. 6 is a plan view of a POD printer feeder.
Figure 7:
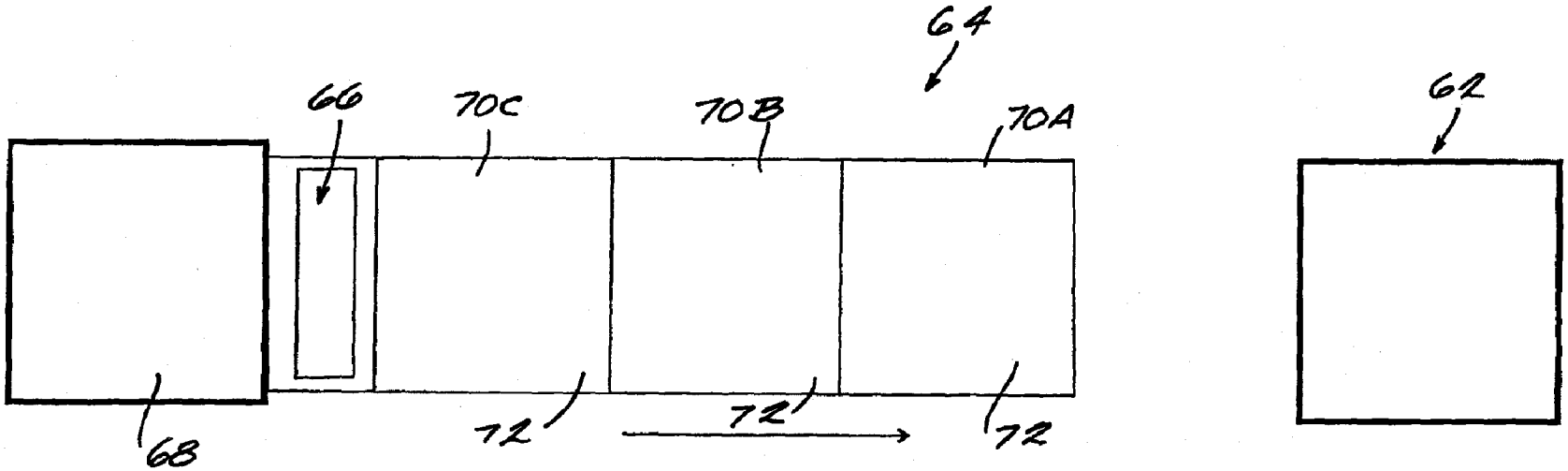
FIG. 7 is a plan view of the POD printer feeder.

Turning now to FIGS. 5-7, another embodiment of the invention is shown. In this embodiment, print-on-demand (POD) technology is utilized as a way to have multiple printed product streams gathered together using one pocket and as a result actually creating one stream. POD technology enables the use of one pocket to combine individual streams of printed products. POD technology can be used in conjunction with traditional feeders and pockets if different sized signatures, varying folding techniques, increased speed, back-up efficiencies, additional color requirements, for example, are desired. In other cases, one POD component may be sufficient.

As shown in FIG. 5, a binding line 60 includes multiple pockets 62. Pockets 62A and 62B have associated therewith a POD feeder 64A and 64B, respectively, each have thereon a POD printer 66A and 66B, respectively.

Multiple POD technology components can be used on the binding line 60 as shown in FIG. 5. As an example, the first POD feeder 64A prints and feeds the driver piece using a bar code as described above and the second POD feeder 64B prints and feeds in sequence to match the driver piece. Scanners, cameras or similar technology could be used to verify that the match of these signatures have in fact been established.

Referring now to FIGS. 6 and 7, POD technology enables all the information required on the printed products, such as a signature, to be printed at the same time. Borders, varying colors, common text and/or variable text, for example, can all be printed on demand in real time, therefore, individual streams of printed products can be printed as one mail stream and with the use of one pocket. Examples of POD technology include the VersaMark Printing System available from Scitex and the DocuTech Production Printer available from Xerox. A blank roll of paper 68 is fed to the POD printer 66 which prints each individual printed product, such as signatures 70A, 70B and 70C. The printed products 70 are then fed to the pocket 62.

It should be noted that with all embodiments, books do not need to be assembled in the exact assembly order to ensure that the books are being manufactured correctly. Due to the sequence code and/or POD technology being utilized, a book can be assembled correctly as controlled by the controller, based on the code alone, regardless of sequence order. If mailing requirements change, the precise sequence the books are manufactured in becomes less important.

The present invention is not limited to the forms shown and described above. Alternate forms will be apparent to those skilled in the art and are within the intended scope of the present invention. The forms described herein are further intended to explain the best modes known for practicing the invention and to enable those skilled in the art to utilize the invention in such, or other, forms and with various modifications required by the particular applications or uses of the present invention. It is intended that the appended claims be construed to include alternative forms to the extent permitted by the prior art.

What is claimed is:

1. A method of delivering signatures to a finishing line comprising:

generating an assembly order;

providing the assembly order to a controller that is operatively associated with a feeder that comprises a print-on-demand printer;

providing paper to the print-on-demand printer of the feeder, the paper being blank when provided to the print-on-demand printer; and controlling with the controller each of the following steps according to the assembly order: generating a signature of the assembly order with the print-on-demand printer of the feeder by printing the entirety of content making up the signature onto a first area of blank paper provided to the print-on-demand printer, feeding the signature to a first pocket on the finishing line, delivering the signature from the first pocket to a conveyor line of the finishing line, generating an additional signature of the assembly order with the print-on-demand printer by printing the entirety of content making up the additional signature onto an additional area of blank paper provided to the print-on-demand printer, feeding the additional signature to the first pocket, and delivering the additional signature from the first pocket to the conveyor line of the finishing line.

2. The method of claim 1, wherein printing the entirety of content making up the signature and printing the entirety of content making up the additional signature comprises printing two completely different sets of content.

3. The method of claim 1, wherein printing the entirety of content making up each of the signature and the additional signature with the print-on-demand printer of the feeder includes printing at least one of: borders, varying colors, common text, and varying text for each of the signature and the additional signature.

* * * * *